US005362019A

United States Patent [19]

Swanson

[11] Patent Number: 5,362,019

[45] Date of Patent: Nov. 8, 1994

[54] POSTAL BOX MOUNTING PEDESTAL

[76] Inventor: Greg Swanson, P.O. Box 813, Fruitland Park, Fla. 34731

[21] Appl. No.: 135,717

[22] Filed: Oct. 13, 1993

[51] Int. Cl.[5] ..... A47G 23/02

[52] U.S. Cl. ..... 248/146; 232/39; 248/121; 248/311.2

[58] Field of Search ..... 248/146, 121, 176, 311.2; 232/39; 52/165, 731

[56] References Cited

U.S. PATENT DOCUMENTS

| | | | |
|---|---|---|---|
| 877,006 | 1/1908 | Scobee | 232/39 |
| 4,120,446 | 10/1978 | Fuemmeler | 232/39 |
| 4,236,665 | 12/1980 | Glass | 232/39 |
| 4,667,918 | 5/1987 | Page | 232/39 X |
| 4,709,853 | 12/1987 | Hahn | 248/146 |
| 5,022,618 | 6/1991 | Barrett | 248/146 |
| 5,031,828 | 7/1991 | Fischer | 232/39 |
| 5,060,900 | 10/1991 | Kokoruda | 248/311.2 |
| 5,060,908 | 10/1991 | Sofy | 52/165 X |

*Primary Examiner*—J. Franklin Foss
*Attorney, Agent, or Firm*—Thomas C. Saitta

[57] ABSTRACT

A mounting pedestal for different postal boxes comprises a base member, a vertical support column and a top member, the top member having two sets of bolt receiving apertures and a rectangular receiving pocket with side walls containing pairs of bolt receiving apertures. The device is connectable to multiple types of postal boxes whether such boxes have planar bottoms or depending male mating structures.

12 Claims, 1 Drawing Sheet

FIG. 1
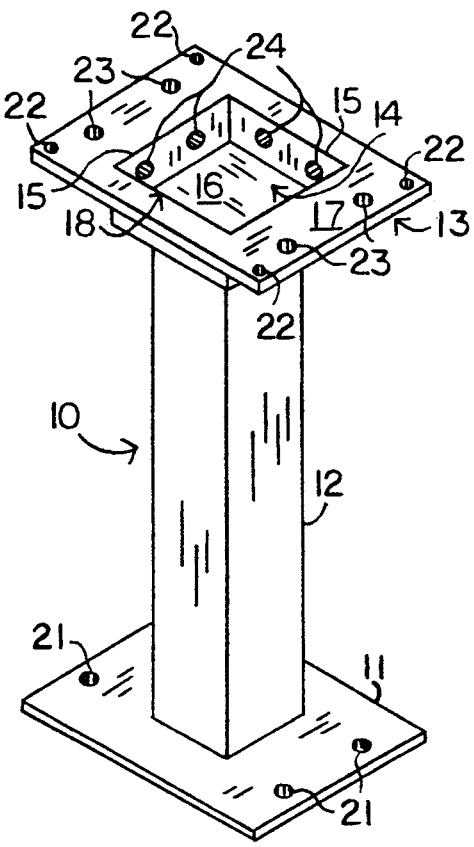
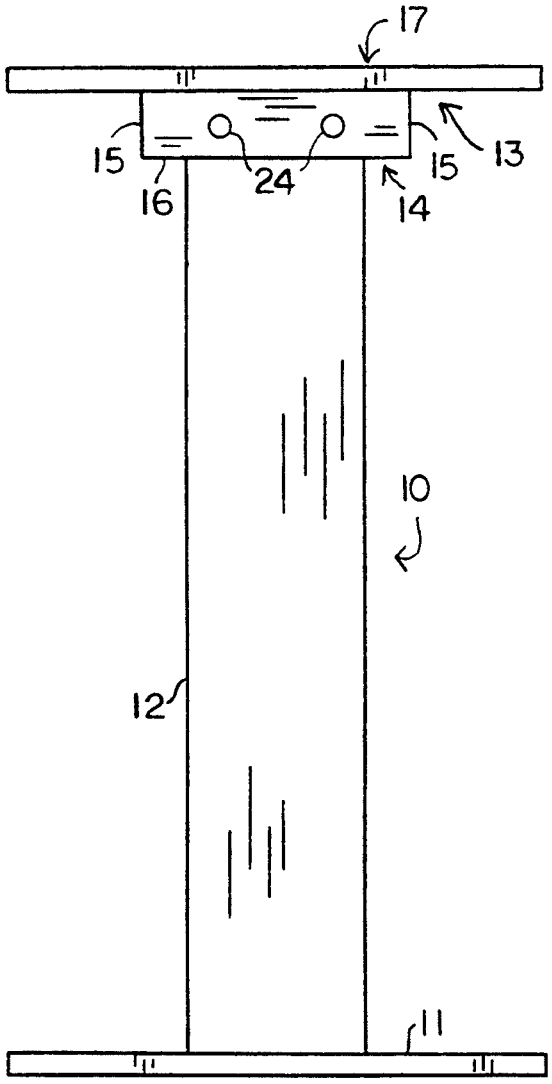
FIG. 2
FIG. 3
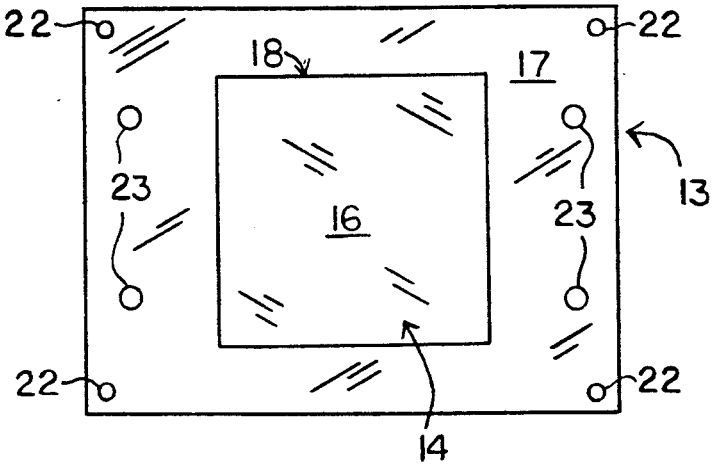

POSTAL BOX MOUNTING PEDESTAL

BACKGROUND OF THE INVENTION

This invention relates generally to the field of mounting pedestals, and more particularly to the field of mounting pedestals for use with postal boxes. Even more particularly, the invention relates to postal box mounting pedestals suitable for use with multiple postal box mating configurations.

A particular problem in the postal industry concerns the task of replacing pedestals used to support postal boxes, the receptacles containing a number of small compartments for individual addresses. This type of postal box is utilized where it is desirable for the carrier to be able to service a large number of addresses at one location, rather than having to make individual deliveries to a number of individual postal receptacles. There are a number of different manufacturers for postal boxes, which has resulted in there being a number of differing constructions for the postal boxes. In replacing the mounting pedestal when the original has become damaged or deteriorated, it is necessary to first determine the type of postal box present at the location, then to obtain the correct mounting pedestal which corresponds to the mating structure of the postal box. This means that a number of different type mounting pedestals must be stockpiled to insure that the correct type will be on hand when needed.

It is an object of the invention to provide a mounting pedestal for postal boxes which can be used with any type of postal box, thereby eliminating the need to determine which particular type of postal box is in use.

It is a further object of the invention to provide such a mounting pedestal which is suitable for use with postal boxes having superior or extended mating configurations, as well as for use with postal boxes having flat mating configurations with varying bolt locations.

SUMMARY OF THE INVENTION

The invention comprises a mounting pedestal for a multiple compartment postal box, commonly known as an NDCBU (Neighborhood Delivery Collection Box Unit). The mounting pedestal comprises a base member, a vertical column member, and a horizontal top plate member containing a receiving pocket. The base member is a horizontal plate having apertures positioned to receive vertically extending bolts extending from the installation pad. The vertical column member extends upward from the base member. The horizontal top plate member is the uppermost component of the mounting pedestal and comprises a relatively horizontal, relatively planar upper surface having a number of bolt receiving apertures positioned at various locations and having a generally centrally positioned aperture which accesses the square receiving pocket. The receiving pocket has four generally vertical side walls and preferably a closed horizontal bottom. Bolt receiving apertures are positioned at certain locations in each of the side walls. The mounting pedestal is preferably made of steel or a similar material having suitable strength and durability properties.

BRIEF DESCRIPTION OF THE DRAWINGS

FIG. 1 is a perspective view of the invention.

FIG. 2 is a side view of the invention.

FIG. 3 a top view of the invention.

DETAILED DESCRIPTION OF THE INVENTION

The invention is a mounting pedestal for supporting multiple compartment postal boxes of a type commonly known as NDCBU's (Neighborhood Delivery Collection Box Units). The postal boxes are rectangular in configuration, having a front side containing a number of individual doors to allow access to the individual compartments assigned to each mail customer. The postal boxes have either a relatively flat or planar bottom, or have a flat bottom with a depending or superior square male mating structure adapted to be received and fastened to a corresponding female mating structure on the mounting pedestal.

With reference to the figures, the mounting pedestal 10 is seen to generally comprise a base member 11, a relatively vertical column member 12 and a top plate member 13. Base member 11 and top plate member 13 are relatively horizontal, i.e., relatively perpendicular to column member 12—the directions referring to relative positions when the mounting pedestal 10 is attached to an installation pad, typically a concrete slab, for use in the field. The mounting pedestal 10 is preferably constructed of a strong, durable metal, such as steel, although any material having suitable strength and durability properties can be used.

Base member 11 is adapted for connection to an installation pad having upwardly protruding bolts which extend through base apertures 21. Base apertures 21 are preferably sized at $\frac{5}{8}$ inches in diameter and four such apertures are positioned in a rectangular configuration with center to center side distances of 10 inches by 4 inches. It is preferable that the base apertures 21 be sized larger than necessary to receive the bolts extending from the installation pad to compensate for misplacement or misalignment of the bolts. Base member 11 is preferably rectangular in configuration and sized at approximately 12 inches by 6 inches. Column member 12 extends vertically from the center of base member 11, and is 4 inches by 4 inches and approximately 30 inches tall as shown, although the dimensions of this component may vary.

Top plate member 13 is rigidly attached to the top of column member 12 and comprises a relatively flat rectangular member, such that the top plate upper surface 17 is relatively perpendicular to the vertical axis of the column member 12. The upper surface 17 is preferably generally flat or planar, with an outer perimeter dimensioned at 12 inches by 9 inches, preferably. Centered in the upper surface 17 of top plate member 13, corresponding to the central vertical axis of column member 12, is a square top plate pocket aperture 18. Mounted to the horizontal portion of top plate 13 within this pocket aperture 18 is receiving pocket 14. Receiving pocket 14 comprises four generally vertical side walls 15 depending from the upper surface 17 and preferably a bottom member 16. Column member 12 is rigidly connected to the underside of pocket bottom 16. Receiving pocket 14 is preferably dimensioned to have a depth of about 1.5 inches and inner dimensions from one side wall 15 to the opposite side wall 15 of about 5.75 inches, this being the required configuration to snugly receive the depending male mating member of a superior type postal box. Symmetrically positioned relative to the lateral midpoint of each side wall 15 of receiving pocket 14 is a pair of pocket apertures 24, separated by a center to center distance of approximately 2.75 inches, with each pocket aperture being about ½ inch in diameter and positioned about 1 inch above bottom member 16.

Two sets of apertures are positioned on upper surface 17 of top plate member 13, each set symmetrically centered relative to the center point corresponding to the vertical axis of column member 12. The first top plate apertures 22 are four in number and are approximately ⅜ inches in diameter, positioned in a rectangular configuration of 11 inches by 8 inches. First top plate apertures 22 are preferably threaded. The second top plate apertures 23 are also four in number and are approximately ½ inches in diameter, positioned in a rectangular configuration of 10 inches by 4 inches. As with base member apertures 21, pocket apertures 22, first top plate apertures 23 and second top plate apertures 24 may be sized larger than necessary to compensate for misalignment of the mounting bolts or holes in the postal boxes.

The various sets of apertures are designed to accommodate the main types of postal boxes currently in use. Postal boxes having flat bottoms are bolted to the mounting pedestal 10 either through first top plate apertures 22 or through second top plate apertures 23, the postal boxes having bolt receiving apertures corresponding to the 11 inches by 8 inches configuration or the 10 inches by 4 inches configuration, respectively. The receiving pocket 14 of top plate 13 is adapted to receive the depending male mating member of superior postal boxes, with the pocket apertures 24 aligning with bolt receiving apertures in the male mating member and the bottom of the postal box resting on the top plate upper surface 17. Because the mounting pedestal 10 is connectable to any of the postal box configurations, there is no need for individualized replacement pedestals.

It is understood that those skilled in the art may be aware of obvious equivalents or substitutions for elements described above. The true scope and definition of the invention therefore is to be as set forth in the following claims.

I claim:

1. A mounting pedestal suitable for attachment of various postal boxes having different mounting configurations and shapes, said mounting pedestal comprising:

(A) a generally planar, horizontal base member having a number of bolt receiving apertures adapted to be connected to an installation pad;

(B) a generally vertical support column connecting said base member to a top member; and (C) a generally horizontal top member having a generally planar upper surface containing a number of bolt receiving apertures corresponding to various apertures in different postal boxes, and a generally rectangular receiving pocket centrally depending from said top member to create a rectangular aperture in said top member, said receiving pocket having four side walls depending from said top member, said side walls each containing a number of bolt receiving apertures corresponding to apertures in a postal box having a generally rectangular depending mating structure.

2. The device of claim 1, where said receiving pocket is approximately five and three quarter inches by five and three quarter inches and said side walls are approximately one and one half inches in height.

3. The device of claim 2, where said apertures in said side walls comprise four pairs of apertures, each said pair of apertures having a center to center distance of approximately two and three quarter inches and positioned symmetrically relative to the lateral midpoint of each said side wall.

4. The device of claim 3, where said apertures are approximately ½ inches in diameter.

5. The device of claim 1, where said apertures in said top member comprise first and second set of apertures, said first set of apertures positioned in a rectangular configuration of eight inches by eleven inches and said second set of apertures positioned in a rectangular configuration of four inches by ten inches.

6. The device of claim 5, where said first set of apertures are each approximately ⅜ inches in diameter and said second set of apertures are each approximately ½ inches in diameter.

7. The device of claim 6, where said first set of apertures are threaded.

8. The device of claim 1, where said apertures in said base member are positioned in a rectangular configuration of four inches by ten inches.

9. The device of claim 8, where said apertures are each approximately ⅝ inches in diameter.

10. A mounting pedestal suitable for attachment of various postal boxes having different mounting configurations and shapes, said mounting pedestal comprising:

(A) a generally planar, horizontal base member having four bolt receiving apertures each approximately ⅝ inches in diameter positioned in a rectangular configuration of four inches by ten inches and adapted to be connected to an installation pad;

(B) a generally vertical support column connecting said base member to a top member; and (C) a generally horizontal top member having a generally planar upper surface containing a first and second set of bolt receiving apertures, said first set of apertures each approximately ⅜ inches in diameter and positioned in a rectangular configuration of eight inches by eleven inches, said second set of apertures each approximately ½ inches in diameter and positioned in a rectangular configuration of four inches by ten inches, and a generally rectangular receiving pocket approximately five and three quarter inches by five and three quarter inches centrally depending from said top member to create a rectangular aperture in said top member, said receiving pocket having four side walls approximately one and one half inches in height depending from said top member, each of said side walls containing a pair of bolt receiving apertures each approximately ½ inches in diameter and each pair having a center to center separation distance of approximately two and three quarter inches and positioned symmetrically to the lateral midpoint of each said wall.

11. The device of claim 10, where said first set of apertures are threaded.

12. The device of claim 10, where said first set of apertures in said top member, said second set of apertures in said top member and said receiving pocket are all centered on the vertical axis of said vertical support column.

* * * * *